United States Patent [19]

Sato

[11] 4,048,776

[45] Sept. 20, 1977

[54] STEEL COLUMN BASE MEMBER

[75] Inventor: Kuniaki Sato, Hiratsuka, Japan

[73] Assignee: Kajima Corporation, Tokyo, Japan

[21] Appl. No.: 385,166

[22] Filed: Aug. 2, 1973

[30] Foreign Application Priority Data

Aug. 21, 1972 Japan ..... 47.82799
Aug. 21, 1972 Japan ..... 47.82800

[51] Int. Cl.[2] ..... E04H 12/22; E04C 3/02

[52] U.S. Cl. ..... 52/297; 52/298; 248/188.8; 248/188.1; 248/346

[58] Field of Search ..... 52/295, 298, 300, 301, 52/296, 297; 248/346, 19, 188.8, 188.1

[56] References Cited

U.S. PATENT DOCUMENTS

| | | | |
|---|---|---|---|
| 134,269 | 12/1872 | Gray | 52/301 |
| 198,072 | 12/1877 | Bonzano | 52/298 |
| 950,806 | 3/1910 | Richardson | 52/301 |
| 1,258,409 | 3/1918 | Hill | 248/357 |
| 1,488,128 | 3/1924 | Macdonald | 29/482 |
| 1,887,399 | 11/1932 | Costello | 248/188.91 |
| 2,179,774 | 11/1939 | Zerbe | 29/483 |
| 2,867,036 | 6/1959 | Hovelmann | 29/482 |

*Primary Examiner*—Price C. Faw, Jr.
*Assistant Examiner*—James L. Ridgill, Jr.

[57] ABSTRACT

A steel column base member for connecting structural steel column member to a concrete foundation, which base member is an integral molded or die-forged body comprising a base plate portion to engage the foundation, a projected portion to be joined to the column, and smoothly curved sidewalls extending from the base plate portion to the projected portion. The top surface of the projected portion is of substantially identical shape with the cross section of the column.

6 Claims, 14 Drawing Figures

STEEL COLUMN BASE MEMBER

BACKGROUND OF THE INVENTION

1. Field of the Invention

This invention relates to a steel column base plate member, and more particularly to a steel base member for connecting a steel column member of a steel structure to concrete foundation therefor.

2. Description of the Prior Art

Steel column members of architectural buildings or construction structures are connected to concrete foundations, by means of base plates. It is well known that the steel column is stronger than the concrete of the foundation by a factor of not smaller than 10. To compensate for such difference of the strength between the concrete of the foundation and the steel column, the lower end of the column is joined to a steel plate, and the base plate is secured to the concrete foundation by means of anchor bolts embedded in the concrete foundation. The joints between the column and the base plate and between the base plate and the anchor bolts may be effected by riveting or by welding or by bolt-and-nuts. To supplement the rigidity of the base plate, suitable ribs are integrally secured to the base plate. Whereby, mechanical load or stress acting on the steel column is transmitted to the concrete foundation through the entire contact area between the base plate and the concrete foundation, so as to avoid any excessive stress concentration in the concrete foundation.

More particularly, it has been a practice to spread the load of the steel column to the surface area of the base plate, most frequently ribbed base plate, for the purpose of preventing the concrete foundation from breakdown by direct application of the high steel column stress to the concrete foundation. The tensile stress from the steel column is borne by the anchor bolts. The dimensions of the base plate, the anchor bolts and the concrete foundation are designed on the basis of the aforesaid stress transmission from the steel column to the concrete foundation.

Generally speaking, the mechanical loading to the steel column of building and construction structure includes axial compression, bending moment, and shearing stress. The aforesaid three elements of the mechanical loading are simultaneously applied to the steel column, and the concrete portion of the foundation and the anchor bolts jointly bear such mechanical loading. The concrete portion of the foundation produces a reaction force to be applied to the base plate, in response to that portion of the mechanical loading which is borne by the concrete. When the axial tension is high in the steel column, the anchor bolts will bear such high axial tension.

Accordingly, the base plate is required to fulfill the following conditions.

1. Since a large grounding force is applied to the base plate, the base plate must have a sufficiently large mechanical strength and rigidity to withstanding against outward bending moment (positive bending moment).
2. The anchor bolts are sometimes subjected to tension. In this case, a reactive force is generated in the proximity of those bolt holes of the base plate which are for the anchor bolts subjected to the tension. Such reaction tends to cause an outward bending stress (negative bending moment), so that the base plate should also have a sufficient strength and rigidity for withstanding against such outward bending stress.
3. The bending moment and shearing force which act on the column base plate are caused by earthquakes and typhoons, so that such moment and force are alternatingly oriented to different directions. Thus, the strength and the rigidity of the base plate should be symmetrical with respect to the vertical central axis of the steel column. The base plate is required not only to withstand against any foreseen load (breakdown strength), but also to restrict the magnitude of strain or deformation thereof (rigidity).

To meet such requirements of dynamic and static nature, those portions of the base plate which are exposed to the effect of predicted high bending stresses should have a sufficient thickness for ensuring the strength necessary for bearing such effect of the stresses. On the other hand, it has been a practice to use a base plate of uniform thickness. Accordingly, the thickness of the conventional base plate must be selected, on the basis of the required thickness at that portion of the base plate where the maximum outward bending stress is caused. In practice, a comparatively thin steel plate is used for the base plate on the basis of normal maximum stress, for the purpose of economy. To supplement the strength, rib plates are secured to the base plate. The joint of the rib plates to the base plate cooperates with the joint of the steel column to the base plate in dividing the base plate in sections, so as to bear the outward bending moment acting thereto by the sections thus formed. Such division results in a reduction of the magnitude of the outward bending moment, and it also increases the resistance of the base plate against deformation.

The conventional base plate of the aforesaid structure has the following shortcomings.

a. The steel column is directly joined to the base plate by welding, and the welding tends to cause strain in the base plate. Due to such welding strain, sometimes, it has been difficult to achieve stable planar contact surface between the steel base plate and the concrete foundation. To ensure the planar contact, the welding strain is removed by extra treatment, such as heating or grinding, but such extra treatment means an additional working time and cost.
b. The welding of the reinforcing rib plates to the base plate tends to further increase the welding stress in the base plate. Despite such risk, rib plates are actually welded to the base plate, because the ribbed base plate gives the best economy.
c. To obtain maximum improvement of the rigidity of the base plate, it is desirable to weld the rib plates at small intervals. The small rib intervals are, however, detrimental to sound welding thereof, and it becomes difficult to tighten the anchor bolts when the rib intervals are small.
d. The reinforcing ribs present a complicated surface shape to the base plate. Dust particles and moisture are apt to be trapped in the complicatedly shaped surface, which may accelerate the corrosion of the base plate to shorten the service life thereof.

Therefore, an object of the present invention is to mitigate the aforesaid difficulties of the conventional base plates by providing an improved steel column base plate member.

SUMMARY OF THE INVENTION

According to the present invention, there is provided a steel column base plate member, which is formed by molding or die-forging without welding any ribs thereto. Thus, the risk of generating welding strain is completely eliminated. Furthermore, base plate member of the present invention has a projection extending from a planar bottom portion thereof, so as to provide a top surface whose shape is substantially identical to the cross section of a steel column member to be supported by the base plate. There are smoothly curved sidewall portions at the junctions between the projection and the planar bottom portion of the base plate member, so as to eliminate any stress concentration in the base plate member. Holes are provided in the base plate member, for allowing anchor bolts to extend therethrough. Abutments are formed on the base plate member about the anchor bolt holes thereof, so as to strengthen the base plate member at such portions.

With the base plate member of the invention, it is also possible to form J-shaped welding grooves along the top surface of the projection, so as to facilitate the butt welding of the lower end of a steel column member to the base plate member.

BRIEF DESCRIPTION OF THE DRAWING

For a better understanding of the invention, reference is made to the accompanying drawing, in which.

Like parts are designated by like numerals throughout the different figures of the drawing.

DETAILED DESCRIPTION OF THE PREFERRED EMBODIMENTS

Figure 1:
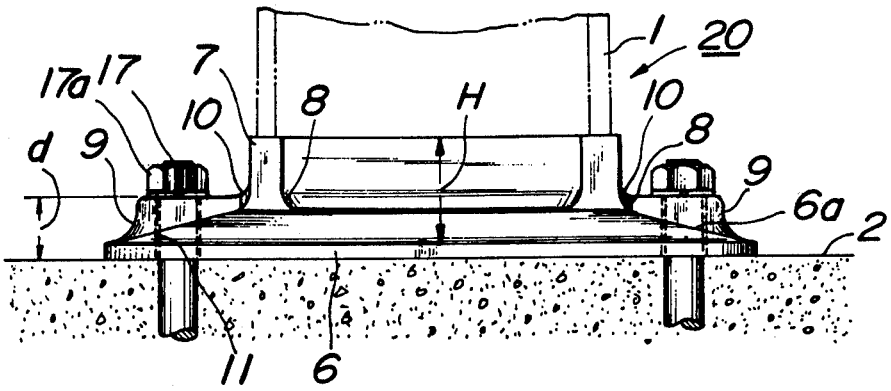
FIG. 1 is an elevation of a steel column base plate member for supporting an H-shaped column member, according to the present invention.

Referring to FIGS. 1 to 4, a steel column base plate member 20 according to the present invention is to join a steel column member 1 to a concrete foundation 2. The base plate member 20 itself is secured to the concrete foundation 2 by anchor bolts 17 and nuts 17*a*.

The base plate member 20 has a planar bottom plate portion 6 whose bottom surface area is large enough to distribute the load of the steel column member 1 to the concrete foundation 2 at a stress which is below an allowable limit to the concrete member of the foundation 2 through the interface between the base plate member and the concrete foundation. A projection 7 is integrally formed with the planar bottom portion 6 so as to form a top surface 7*a* whose shape is substantially identical to the cross section of the steel column member 1. In the embodiment of FIGS. 1 to 4, the steel column member 1 is of H-shape, so that the top surface 7*a* of the projection 7 is similarly H-shaped.

Figure 5:
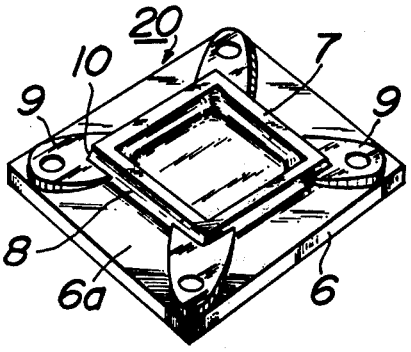
FIGS. 5 and 6 are perspective views of different embodiments of the steel column base plate member, which are to support a box-shaped steel column member and a tubular steel column member, respectively.
Figure 6:
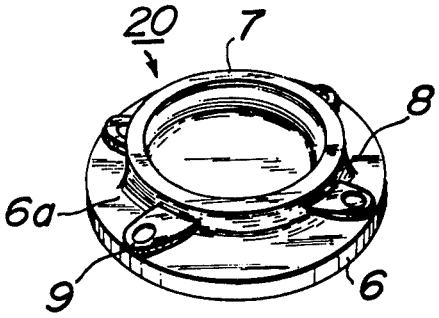

FIGS. 5 and 6 illustrate steel column base plate members 20 of the present invention, which are designed to support steel column members of box-shape and tubular shape, respectively.

Referring to FIG. 1, the height H of the projection 7 is determined on the basis of the ease of welding the column member 1 to the top surface 7*a* and the suppression of the welding strain or bending of the base plate member 20 due to the welding of the column member 1 thereto.

Smoothly curved surface portions 8 are formed where the projection 7 rises from the planar portion 6, so as to eliminate any stress concentration in the base plate member 20 due to the presence of sharp corners. Thus, the radius of curvature of the curved surface 8 must be chosen on the basis of effective suppression of the stress concentration. Whereby, the smooth transfer of the load of the column member 1 toward the concrete foundation 2 is ensured.

Preferably, the planar portion 6 has a sloped or tapered top surface 6*a*, so that the thickness of the planar portion 6 increases as it extends toward the projection 7. With such sloped top surface 6*a*, the thickness of the planar portion 6 is increased at those parts where the stress is high, while allowing comparatively thin thickness to the less stressed parts thereof. As a result, the rigidity of the projection 7 is enhanced, too. Furthermore, superfluous thickness of the base plate 20 is eliminated.

Figure 2:
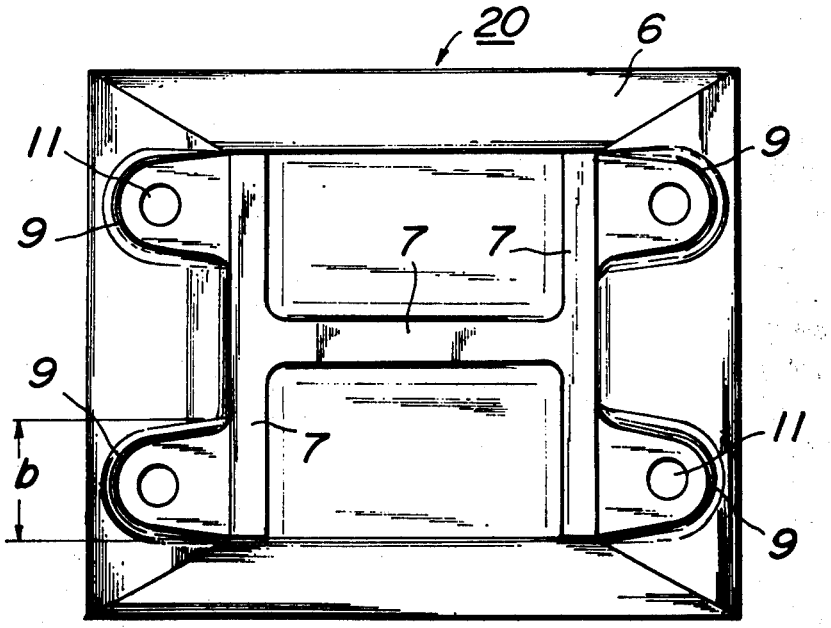
FIGS. 2 and 3 are a plan view and a side view of the base plate member of FIG. 1, respectively.
Figure 3:
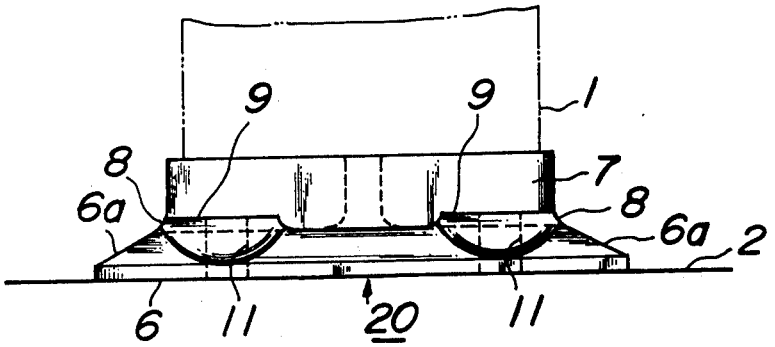
Figure 4:
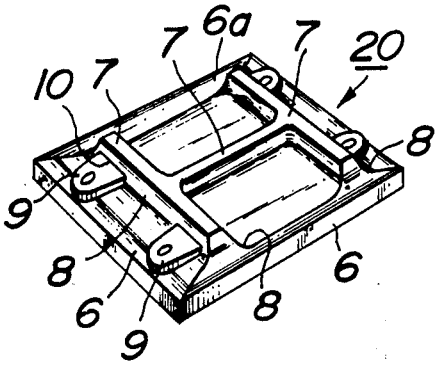
FIG. 4 is a perspective view of the base plate member of FIG. 1.

Abutments 9 are integrally formed at the parts where anchor bolt holes 11 are bored through the base plate member 20. The top surface of the abutment 9 is made parallel to the bottom plane of the planar portion 6, so as to stabilize the contact surface between the nut 17*a* and the abutment 9. It is, of course, possible to insert suitable washers (not shown) between the abutment and the nuts 17*a*. Referring to FIGS. 1 and 2, the width *b* and the thickness *d* of the abutment 9 are so chosen as to ensure smooth transfer of the load of the column member 1 toward the anchor bolts 17. Suitably curved surfaces 10 are formed at the junction between the abutment 9 and the projection 7, for preventing stress concentration thereat.

The steel column base plate member 20 of the aforesaid construction may be formed in one step by molding or by die-forging.

The steel column member, e.g., the H-shaped steel member, is made by rolling in a universal mill. Accordingly, once its nominal dimension is determined, the inside dimensions and the radii of curvature at the junctions of different inside surface portions are fixed, regardless of the difference in the thickness of flanges and webs thereof. In fact, the shapes and dimensions of the steel column members to be used in architectural buildings and construction structures are selected from a limited number of varieties. Accordingly, it is comparatively easy to provide such top surface 7*a* of the projection 7 which is of substantially identical shape with the sectional shape of the steel column member 1.

According to the present invention, it is also possible to form J-shaped welding grooves along the top surface 7*a* of the projection 7 for facilitating the butt welding of the lower end of the steel column member 1 to the base plate member 20.

Figure 7:
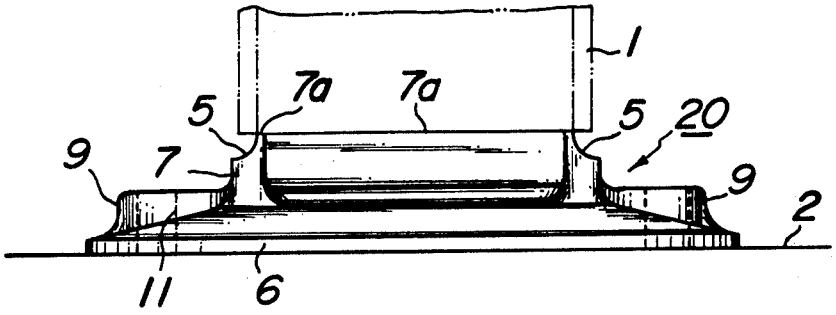
FIGS. 7 to 9 are an elevation, a plan view, and a side view, respectively, of a steel column base plate member having J-shaped welding grooves, according to the present invention.
Figure 8:
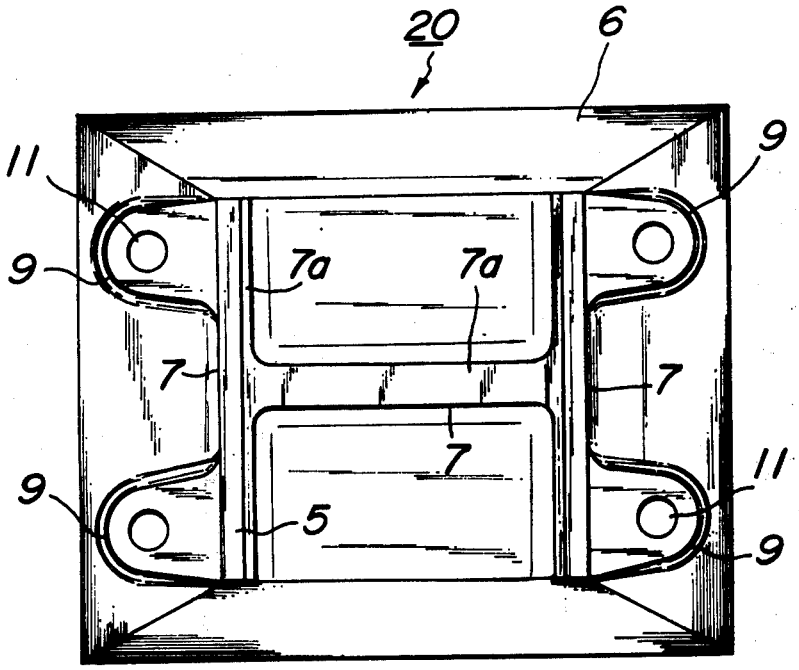
Figure 9:
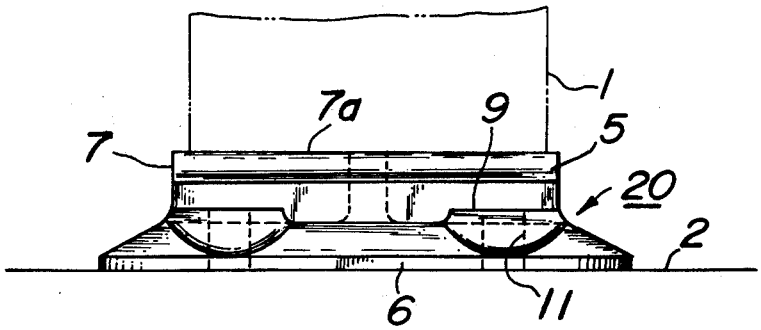

Referring to FIGS. 7 to 9, J-shaped welding grooves 5 are formed at those portions of the top surface 7*a* of a projection 7, which are to face outermost vertical parts of a steel column member 1. Such outermost vertical parts are flanges in the case of an H-shaped steel column member, and four peripheral surfaces in the case of a box-shaped steel column member. The J-shaped welding grooves 5 may be formed at the time of molding or die-forging of the steel column base plate member 20 per se.

Figure 14:
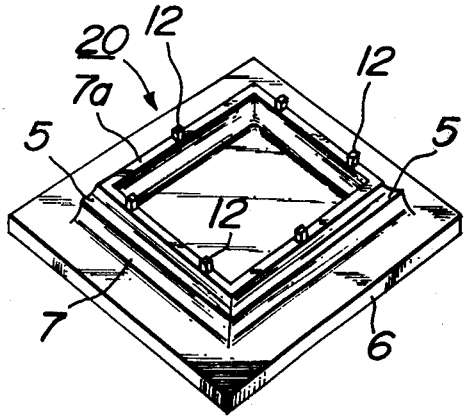

FIG. 14 illustrates a steel column base plate member 20 which has J-shaped welding grooves 5 for welding a box-shaped steel column member thereto.

Figure 13:
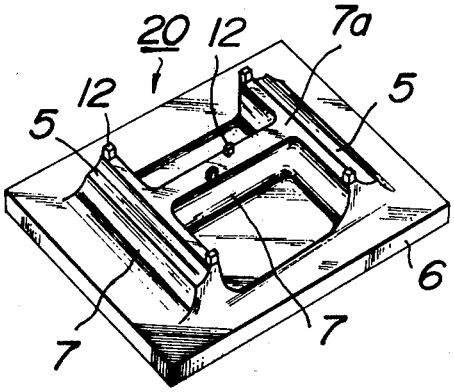
FIGS. 13 and 14 are perspective views illustrating steel column base plate members for supporting H-shaped and box-shaped steel columns, respectively.

To facilitate the correct registering of the steel column member 1 relative to the base plate member 20, suitable bosses 12 may be provided at the top surface 7*a* of the projection 7, as shown in FIGS. 13 and 14.

Figure 10:
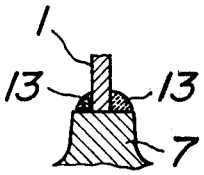
FIGS. 10, 11 and 12 are schematic partial sectional views, illustrating the manner in which a column member is welded to the base plate member of the present invention.
Figure 11:
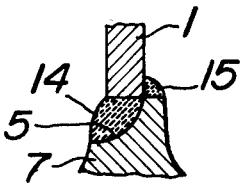

In actual construction, fillet welding beads 13 may be formed along the joint between the web of the H-shaped steel column member 1 and the projection 7 of the base plate member 20, while butt welding beads 14 may be formed along the joint between the flanges of the column 1 and the projection 7, as clearly shown in FIGS. 10 and 11. A sealing bead 15 may be formed before the butt welding, if it is necessary to do so. It is apparent to those skilled in the art that the use of bosses 12, as shown in FIGS. 13 and 14, will facilitate the registration or indexing of the column member 1 with the base plate member 20.

Figure 12:
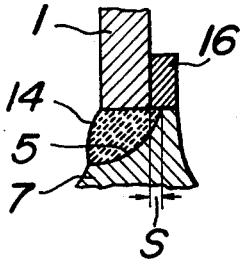

In connecting a box-shaped column member 1 to the base plate member 20, if a gap S is produced between the top surface 7*a* of the base plate member 20 and the lower end of the steel column member 1, as shown in FIG. 12, a strap 16 may be used to prevent the leakage of weld metal through the gap S. Such strap 16 may be attached to the inner surface of the column member 1.

The salient features of the steel column base plate member of the aforesaid construction according to the present invention are as follows.

1. The steel column base member 20 has a rational configuration. The maximum stress in the base plate member is caused at the junction between the column member and the base plate member. With the construction of the present invention, the projection 7 for the connection to the steel column member 1 also provides the thickest portion of the base plate member, so that the maximum thickness is provided at parts where the maximum stress is applied.

Furthermore, smoothly curved surfaces 8 are formed at the junctions between the projection 7 and the planar bottom portion 6, so as to prevent stress concentration at the junctions and to ensure uniform stress distribution at the lower surface of the planar bottom portion 6.

In addition, the shape of the steel column base plate member 20 of the present invention is easy to form.

2. The steel column base plate member 20 has no ribs, so that the anchor bolts 17 can be fastened to the base plate member 20 more easily than with conventional ribbed base plates.
3. The use of the welding connection of the column member 1 to the base plate member 20 allows the column member to be erected as cut by sawing or as cut by gas flame. The formation of the welding grooves on the column member at site is difficult, but the present invention uses welding grooves formed on the base plate member 20.
4. The welding connection of the column member 1 to the projection 7 minimizes the risk of causing welding stress or deformation of the base plate member. The base plate member of the present invention is at least free from welding deformation, as experienced with conventional ribbed base plates.
5. The base plate member 20 of the present invention is suitable for mass production. The varieties of the size and the shape of steel column members 1 to be used in architectural buildings and construction structures are limited. Accordingly, the variety of the shape of the top surface 7*a* of the base plate member 20 is also limited. As the loading conditions for the steel column member 1 vary, the different thicknesses of the base plate member 20 should be selected. Accordingly, with a comparatively small number of molds or forging dies, the limited varieties of the base plate member 20 of the present invention can be easily produced at a comparatively low cost on a mass production basis.
6. The base plate member 20 of the invention is economical, because any superfluous thickness thereof can be eliminated, while providing proper thicknesses to parts where they are actually required. The inventor has found out that the amount of steel necessary for the base plate member 20 can be reduced by more than about 20%, as compared with that of conventional base plates.
7. The base plate member 20 may be produced at factories. Thus, the working time for making the steel frame construction can be greatly reduced. Furthermore, the factory production can ensure good quality control, so as to improve the economy and the stability of the steel column base plate members.
8. The simplified surface shape of the base plate member 20 eliminates the risk of entrapping dust particles and moisture thereon. As a result, the danger of quick corrosion is eliminated and a long service life is ensured.
9. With the J-shaped welding grooves 5, the welding operation can be started immediately after registering the steel column member 1 in position, so that the erection of the steel frame can be accelerated.

The formation of the J-shaped welding groove at site has been considered very difficult. With the base plate member 20 of the present invention, such difficulty is removed.

The J-shaped welding grooves 5 economize the welding operation by minimizing the amount of the weld metal, while ensuring sufficient mechanical strength at the welded joints. The base plate member 20 with the J-shaped welding grooves also makes the welding operation easier, as compared with conventional base plates. In addition, the provision of the J-shaped welding grooves on the side of base plate member simplifies the manufacture of the steel column members. The reliable welded joints at the base plate member improves the stability of the steel frame structure.

10. The use of the projection 7 with the top surface 7*a* to be butt welded to the lower end of the steel column member 1 enables the delivery of the steel column members as saw cut or as gas cut. This means not only the simplification of the steel column members but also the removal of strict accuracy requirement in the production of the steel column member, as far as the lower edges thereof are concerned.

What is claimed is:

1. A steel column base member for connecting a steel column member to a concrete foundation said member having a unitary body and comprising:

a substantially planar bottom plate portion engageable with said concrete foundation;

a projection extending from said bottom plate portion said projection having a top surface whose shape is substantially identical to the cross-sectional shape of the steel column member; said portion designed to support said column member a sloped top surface connecting a bottom of said projection to said bottom plate portion to increase the thickness thereof as the planar bottom plate portion extends toward the bottom of said projection;

smoothly curved surface portions at junctions between the projection and the sloped top surface;

J-shaped welding grooves along edges of said top surface which face outer vertical parts of the steel column members;

abutments formed on the planar bottom portion and having anchor bolt holes bored therethrough and smoothly curved surface portions at the junctions between the abutments and the planar bottom portions.

2. A steel column base member for connecting a steel column member to a concrete foundation, said member having a unitary body and comprising:

a substantially planar bottom plate portion engageable with said concrete foundation;

a projection extending from said bottom plate portion said projection having a top surface whose shape is substantially identical to the cross-sectional shape of the steel column member;

a sloped top surface connecting a bottom of said projection to said bottom plate portion to increase the thickness thereof as the planar bottom plate portion extends toward the bottom of said projection;

smoothly curved surface portions at junctions between the projection and the sloped top surface;

J-shaped welding grooves along edges of said top surface which face outer vertical parts of the steel column member;

abutments formed on the planar bottom portion and having anchor bolt holes bored therethrough; and smoothly curved surface portions at the junctions between the abutments and the planar bottom portion.

3. A steel column base plate member according to claim 2, wherein said top surface has indexing bosses which are integrally formed therewith.

4. A steel column base plate member according to claim 2, wherein said top surface is of H-shape so as to support an H-shaped steel column member.

5. A steel column base plate member according to claim 2, wherein said top surface is of hollow rectangular shape so as to support a box-shaped steel column member.

6. A steel column base plate member according to claim 2, wherein said top surface is annular so as to support a tubular steel column member.

* * * * *